US006154182A

United States Patent [19]

McLean

[11] Patent Number: 6,154,182

[45] Date of Patent: Nov. 28, 2000

[54] EXTENSIBLE TOP-LOADED BICONICAL ANTENNA

[75] Inventor: James Stuart McLean, Austin, Tex.

[73] Assignee: EMC Automation, Inc., Cedar Park, Tex.

[21] Appl. No.: 09/274,983

[22] Filed: Mar. 23, 1999

[51] Int. Cl.[7] ..... H01Q 13/00; H01Q 9/00

[52] U.S. Cl. ..... 343/773; 343/752

[58] Field of Search ..... 343/752, 773, 343/821

[56] References Cited

U.S. PATENT DOCUMENTS 2,368,663 2/1945 Kandoian ..... 343/773

3,787,865 1/1974 McDowell et al. ..... 343/773

3,987,456 10/1976 Gelin ..... 343/830

4,851,859 7/1989 Rappaport ..... 343/790

*Primary Examiner*—Tan Ho

*Attorney, Agent, or Firm*—Darby & Darby

[57] ABSTRACT

An extensible top-loaded biconical antenna is modified to improve low frequency performance while retaining standard performance specifications when needed. The biconical antenna includes a balun and a pair of conical outrigger assemblies coupled to said balun. A conducting tophat plate is removably attached to the ends of each outrigger assembly. The tophats increase the capacitance of the antenna, thereby improving its low frequency gain by 10 dB or more.

22 Claims, 3 Drawing Sheets

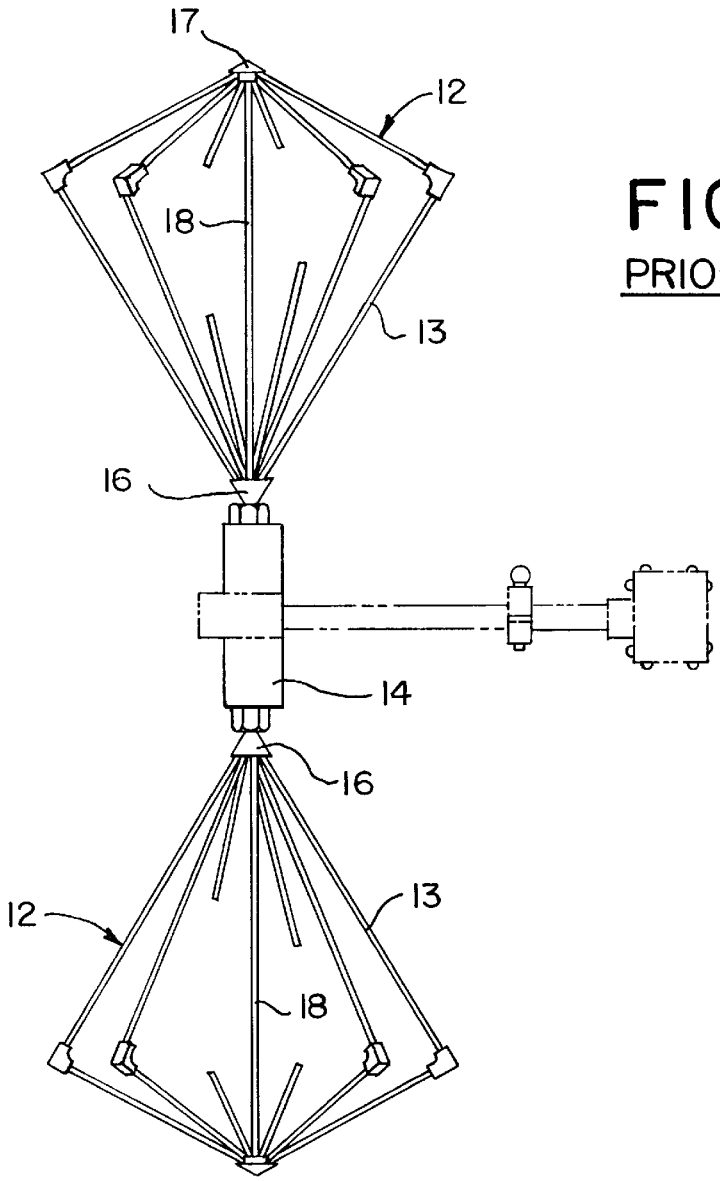
FIG. 1
PRIOR ART
FIG. 2a
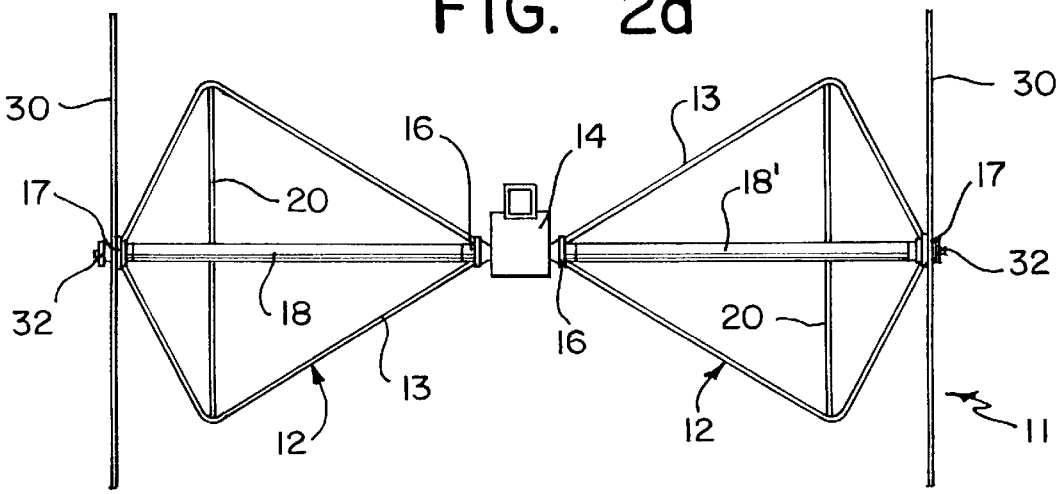

EXTENSIBLE TOP-LOADED BICONICAL ANTENNA

FIELD OF THE INVENTION

This invention is related to a biconical antenna system and, in particular, to a biconical antenna system which can be selectively top-loaded to improve low frequency performance.

BACKGROUND OF THE INVENTION

A biconical antenna, as well as other similar tapered dipole and monopole antennas, including bowtie or Brown-Woodward dipoles and discones, can provide a very broad impedance bandwidth. However, this performance does not extend down into the range in which the antenna is electrically-small. For example, a biconical antenna with a flare angle of 120 degrees can be matched using a 4:1 balun to provide better than 2:1 VSWR over a 6:1 bandwidth. However, the antenna is about one-half wavelength wide at the lower end of this operating band. Thus, as the frequency of interest drops below the operating band, the relative electrical size of the antenna becomes small when compared with the wavelength, decreasing the efficiency of the antenna significantly.

The biconical antenna is of particular interest in applications such as testing noise immunity and electromagnetic emissions. To ensure that the results of such tests are repeatable and can be compared with the results of other tests using different biconical antennas, various well accepted standard antenna specifications have been developed. Once such standard biconical antenna design, defined by U.S. Military Standard 461A (Aug. 1, 1968) is illustrated in FIG. 1.

As depicted in FIG. 1, a conventional biconical antenna 10 used in the EMC industry comprises two outrigger assemblies 12 which are skeletal approximations of a conic surface. The outrigger assemblies 12 are connected to a matching balun 14 by an appropriate coupling 16. The outrigger assemblies are formed of ribs 13 connected between the coupling 16 and endpoint 17 of a central support 18. The balun 14 is used to transfer received and transmitted energy between the antenna 10 and a suitable transmitter and/or receiver, respectively. The antenna 10 is about 1.37 meters in width and has a flare angle of 30 degrees.

For biconical antennas of this type, it is generally expected that good performance can be obtained for frequencies above 100 MHz and, in fact, most commercially available biconical antennas complying with MIL-STD-461A provide excellent performance from 100 MHz to 300 MHz. Acceptable performance can often extends to 60 MHz. However users often attempt to use the biconical antenna at frequencies down to 26 MHz. Unfortunately, these biconical antennas are notorious for poor performance in the 30–60 MHz range. In fact, at 30 MHz, the input match for these commercial antennas is so poor that input VSWR is actually determined primarily by line and balun losses. The poor input match results in extremely high "mismatch loss" and thus severely reduces gain.

Thus, the ability of the traditional 1.37 meter biconical antenna to generate electric field (for immunity testing) with a given input power is very poor. A further consequence of the extreme mismatch is the high voltage at the input connector generated by the near doubling of the input voltage over that which would exist on a matched line with the same forward power. This doubling of the input voltage stresses connectors to the point that they often fail from electric field breakdown.

Despite poor low frequency performance, the biconical antenna has attained universal acceptance in the EMC industry. The design of the 1.37 meter biconical antenna is rooted firmly in MIL-STD 461. Its design is very much standardized and biconical antennas from any of the leading EMC test equipment manufacturers perform almost identically. This ensures that repeatable measurements can be obtained without regard for the antenna manufacturer. In addition, the standard biconical antenna design provides a mechanically robust easily-transported, and rapidly-assembled device. Because of this, users of biconical antennas are reluctant to adopt any designs which depart drastically from the standard.

Various techniques have been proposed to improve the performance of biconical antennas in the low frequency range. In one technique, an impedance matching network is incorporated into the BALUN enclosure to improve the input VSWR for the biconical antenna over the 30–60 MHz range. Because the network is incorporated into the BALUN, no changes to the external geometry of the antenna are required. However, the improvement provided by such a network is generally quite small because no amount of input impedance matching can change the instrinsically high radiation Q of the biconical antenna in the frequency range in which it is electrically-small. In other words, while the biconical geometry provides excellent performance over a frequency range in which it is of moderate electrical size, is simply not a good electrically-small antenna.

Therefore, instead of using a modified biconical antenna, many user rely on a second alternate antenna for work in low frequency ranges. A popular alternate antenna is the top or end loaded dipole. Top loading provides improved performance at low frequencies by increasing the shunt capacity of the antenna, thus lowering the fundamental resonance frequency, and by providing a charge reservoir at the end of the antenna, increasing the current density near the outer ends of the antenna.

Top loaded dipole antennas can be reliably designed to cover the 30–100 MHz range. Unfortunately, the top loaded dipole antenna does not provide good performance over the frequency range in which it is of moderate electrical size. A top-loaded dipole (with 1.37 meter width) antenna provides good performance over the 30–60 MHz range and acceptable performance up to 100 MHz. This is a frequency range which is nearly disjoint, but also nearly complementary, to the 100–300 MHz operating range of the 1.37 meter biconical antenna.

However, while two antennas are sufficient to adequately cover testing from 30 MHz to 300 MHz, their use requires that operators purchase, transport, and store two relatively large antennas. In addition, it is often desired to rapidly make measurements throughout the 30 MHz to 300 MHz range. Unfortunately, decoupling one antenna from the measuring device, removing it from the testing area of interest, and replacing it with the alternate antenna can be cumbersome and time consuming.

Accordingly, it is an object of the present invention to provide a biconical antenna which has good performance over the 100–300 MHz range of conventional antenna designs, while also achieving good performance over the 30–60 MHz range.

It is a further object of the invention to provide a biconical antenna which complies with accepted biconical antenna design standards to provide for repeatable measurements while also being easily and reversibly modified for improved performance at low frequency ranges.

SUMMARY OF THE INVENTION

These and other objects are achieved by the present invention in which a biconical antenna is provided with mounts to accept removable top-loading "tophat" plates. The tophats increase the capacitance of the antenna, thereby improving its low frequency gain by 10 dB or more. For a biconical antenna which complies with MIL-STD 461A, gain for frequencies between 30–60 MHz is increased by 10 dB or more.

When the tophats are detached, the antenna operates as a conventional biconical antenna which complies with, e.g., MIL-STD 461A well as other EMC testing requirements for biconical antennas, and therefore has the expected and repeatable performance over the 30–300 MHz range. When increased performance is needed over the critical low frequency 30–60 MHz range, the tophats can be attached to the antenna. Preferably, the tophat mounting provides appropriate locating and supports to ensure that the tophats can be mounted in the same position each time to provide for repeatable measurements.

BRIEF DESCRIPTION OF THE DRAWINGS

The foregoing and other features of the present invention will be more readily apparent from the following detailed description and drawings of illustrative embodiments of the invention in which:

FIG. 1 is an illustration of a conventional biconical antenna

FIGS. 2*a*–2*c* are illustrations of a biconical antenna having top loading plates according to the invention;

DETAILED DESCRIPTION OF THE PREFERRED EMBODIMENTS

Figure 2B:
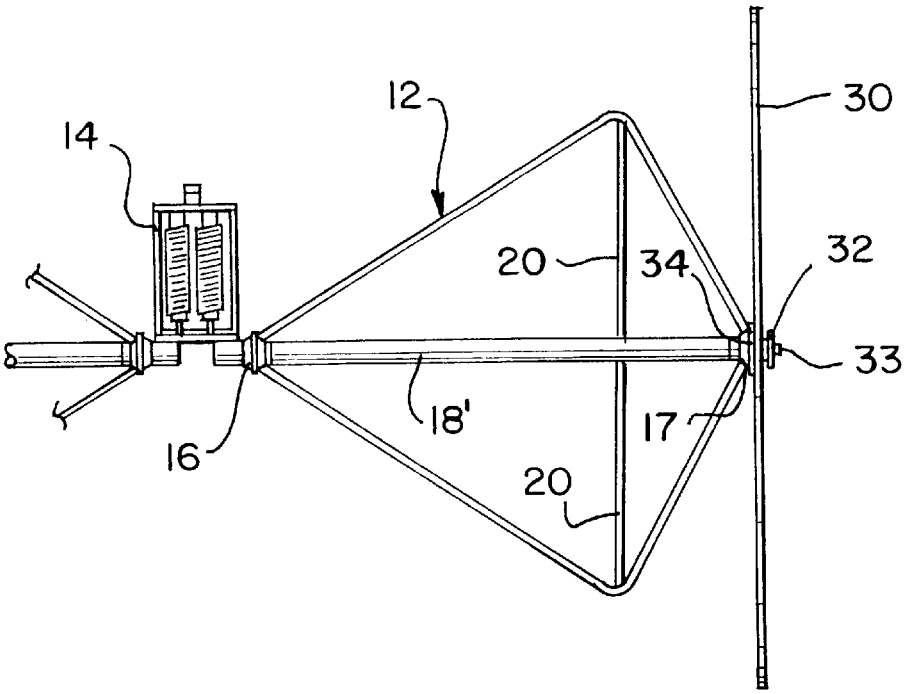
Figure 2C:
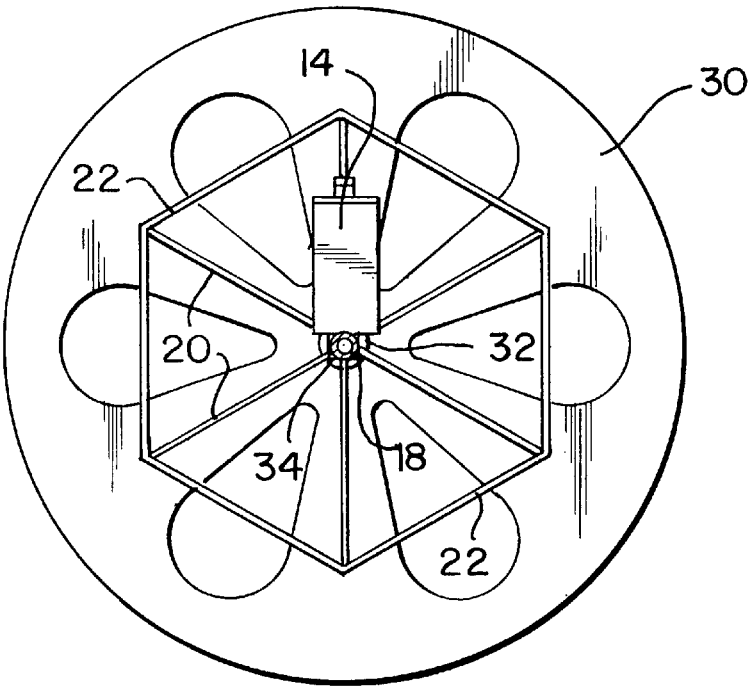

FIGS. 2*a*–2*c* illustrate a biconical antenna 11 according to the invention. The antenna 11 comprises two outrigger assemblies 12 connected to a balun 14 via couplings 16. The outrigger assemblies 12 are connected to a matching balun 14 by an appropriate coupling 16. The outrigger assemblies 12 includes ribs 13 arranged connected between the coupling 16 and an endpoint 17 of a central support rod 18'. The ribs are arranged to approximate a conic surface and, in conjunction with the support rot 18', generally form a 30–60–90 triangle.

A top-loading "tophat" plate 30 is removably attached to each outrigger assembly 12, preferably at the endpoint 17 of the central support rod 18' by a mounting assembly 32. The tophats 30 are generally flat conducting plates. When mounted, the tophats 30 add capacitance to the antenna, thereby increasing its relative diameter and improving its low frequency performance. Preferably, tophats 30 are mounted substantially perpendicular to the support rod 18'. To compensate for the increased bending moment produced by the mounted tophats 30, support rods 18' can be stiffened relative to those in conventional biconical antennas, e.g., by using a tubular support, as opposed to the more conventional solid rod. The antenna can be further strengthened by adding supporting struts 20, 22 if necessary.

Figure 2D:
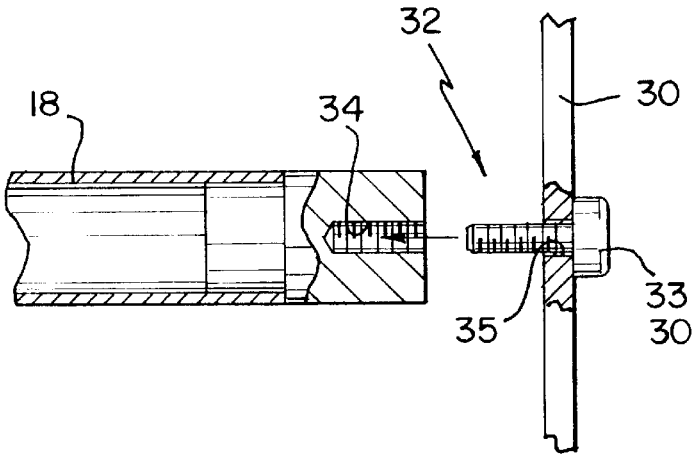
FIGS. 2*d*–2*e* are illustrations of top loading plate mounting assemblies.
Figure 2E:
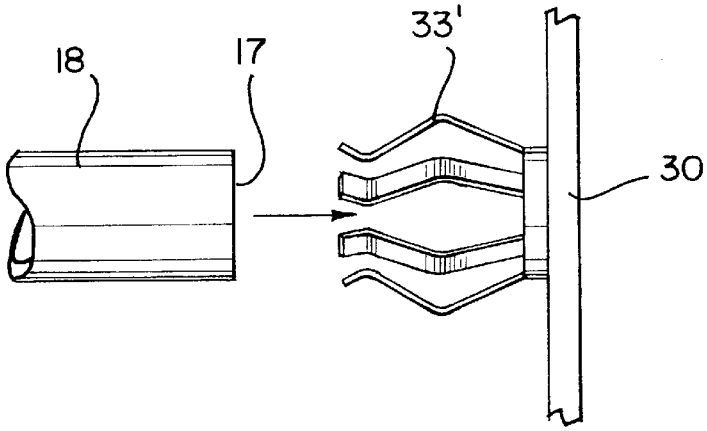

In one embodiment, illustrated in FIG. 2*d*, the mounting assembly 32 comprises a fastener 33, such as a screw or pin, which passes thorough a hole 35 in the center of the tophat and engages a suitable receptacle 34 in endpoint 17 of the support rod 18'. The screw or pin can be separate from the tophat 30 or integrally connected. Preferably, the mounting assembly 32 also includes appropriate locating pins, markings, or is otherwise suitably shaped to ensure that the tophat 30 can be repeatably mounted in the same position to provide for repeatable measurements.

The particular mounting assembly used is not critical to the invention and a wide variety of other removable mounting assemblies can also be used, as will be apparent to one of skill in the art. For example, as shown in FIG. 2*d*, the top hat can be fitted with a spring-like "gripper" 33' which is configured to mate with the end 17 of the support rod 18 in a conventional biconical antenna and retain the tophat 30 in place by compressive friction. In this manner, tophats 30 can be provided which for use with pre-existing biconical antennas. Other configurations are also possible such as frictional mounts, engaging slots and tabs, magnetic clasps or even hook and loop fasteners. Furthermore, the tophats 30 need not be mounted directly to the end of the support rod, but can instead be mounted on the ribs or supporting struts by appropriate mounting components.

The configuration of tophat 30 itself is also not fixed. Preferably the tophat 30 is a generally planar aluminum disk, although non-planar and non-circular configurations of different materials may also be used. The improvement in low-frequency performance provided by the tophats 30 increases with the diameter of the tophat. Preferably, the diameter of the tophat 30 is at least equal to the maximum conic diameter of the outrigger assembly 12.

Figure 3:
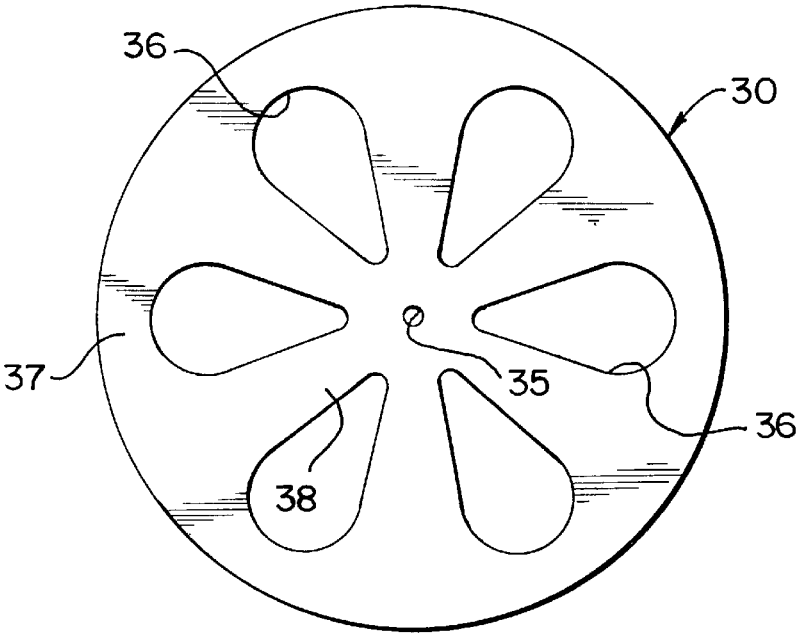
FIG. 3 is an illustration of a top loading plate for use with a biconical antenna.

A preferred design is illustrated in FIG. 3. The tophat 30 is circular and has a plurality of cutouts 36 to reduce its weight. The resulting tophat 30 has an outer rim region 37 with supporting spokes 38. Because electrical charge builds up around the circumference of the tophat 30, the cutouts 36 have only minimal impact on the overall performance. In the most preferred embodiment for a biconical antenna complying with MIL-STD 461A, the maximum conical diameter is approximately 20 inches and the tophat 30 has a diameter of approximately 30 inches.

While the invention has been particularly shown and described with reference to preferred embodiments thereof, it will be understood by those skilled in the art that various changes in form and details may be made therein without departing from the spirit and scope of the invention.

What is claimed is:

1. A conical antenna comprising:

a balun;

at least one outrigger assembly coupled to said balun and comprising a central support rod having a first end adjacent said balun and a second end distant from the balun, a plurality of ribs connected between said balun and the second end of the central support rod, the ribs defining at least one substantially conical surface having a predefined maximum diameter, an apex adjacent the balun, and a mouth opening towards the second end of the central support rod; and a conducting plate removably attached to the outrigger assembly adjacent the second end of the central support rod.

2. The antenna of claim 1, wherein said conducting plate is removably attached to the second end of the central support rod by a mounting assembly comprising first and second engaging components, one of said first and second components associated with said conducting plate, the second of said first and second components associated with said central support rod.

3. The antenna of claim 2, further comprising a gripper extending from said conducting plate at a centrally located point and configured to mate with the second end of the support rod.

4. The antenna of claim 1, wherein:

said conducting plate has a centrally located aperture; and the second end of the central support rod having receptacle therein for receiving a fastener passing through said aperture to secure the conducting plate to the central support rod.

5. The antenna of claim 1, further comprising:

a fastener extending from said conducting plate at a centrally located point;

the second end of the central support rod having a receptacle therein for receiving the fastener.

6. The antenna of claim 1, wherein said conducting plate comprises a disk.

7. The antenna of claim 6, wherein said disk has a diameter at least substantially equal to the predefined maximum diameter.

8. The antenna of claim 6, wherein said disk has a plurality of radially positioned cutouts therein.

9. In a biconical antenna comprising a balun and first and second opposing outrigger assemblies coupled to said balun, each said outrigger assembly comprising a central support rod having a first end adjacent said balun and a second end distant from the balun, a plurality of ribs connected between said balun and the second end of the central support rod, the ribs defining at least one substantially conical surface having a predefined maximum diameter, an apex adjacent the balun, and a mouth opening towards the second end of the central support rod; the improvement comprising:

first and second conducting plates removably attached to said first and second outrigger assemblies, respectively, and positioned such that the mouth of the respective conical surface opens towards the associated conducting plate.

10. The biconical antenna of claim 9, wherein said first and second conducting plates are connected respectively the second end of the central support rod in said first and second outrigger assemblies.

11. The biconical antenna of claim 9, wherein each said conducting plate comprises a disk having a diameter at least substantially equal to the predefined maximum diameter.

12. The biconical antenna of claim 11, wherein each said disk comprises an outer rim and a plurality of radial spokes.

13. A method of improving the low frequency performance of a biconical antenna comprising a balun and first and second opposing conical assemblies coupled to said balun, each conical assembly defining a substantially conical surface having a predefined maximum diameter, an apex adjacent the balun and a mouth opening away from the balun, the method comprising the step of:

attaching a conducting plate having a diameter at least substantially equal to the predefined maximum diameter to each of said first and second conical assemblies such that the mouth of the respective conical surface opens towards the associated conducting plate.

14. The method of claim 13, wherein each conical assembly comprises an outrigger assembly having a central support rod with a first end adjacent said balun and a second end and a plurality of ribs connected between said balun and the second end of the central support rod, the step of attaching comprising attaching said conducting plate to the second end of the central support rod in a respective outrigger assembly.

15. A biconical antenna comprising:

a balun;

first and second opposing conical assembly coupled to said balun, each conical assembly defining a substantially conical surface having a predefined maximum diameter, an apex adjacent the balun, and a mouth opening away from the balun; and first and second conducting plates attached to the antenna and in register with a respective first and second conical assembly such that the mouths of the first and second conical surfaces opens towards the respective first and second conducting plates.

16. The antenna of claim 15, wherein:

each conical assembly comprises a central support rod having a first end adjacent said balun and a second end, a plurality of ribs connected between said balun and the second end of the central support rod, the ribs defining the substantially conical surface.

17. The antenna of claim 16, wherein the conducting plate is attached to the second end of the respective central support rod.

18. The antenna of claim 15, said conducting plate comprises a disk having a diameter at least substantially equal to the predefined maximum diameter.

19. The antenna of claim 18, wherein said disk comprises an outer rim and a plurality of radial spokes.

20. A biconical antenna comprising:

a balun;

first and second opposing conical assembly coupled to said balun, each conical assembly defining a substantially conical surface having a predefined maximum diameter, an apex adjacent the balun, and a mouth opening away from the balun;

each conical assembly further comprising a mounting assembly to which a conducting plate can be mounted in register with the particular conical assembly, wherein when the conducting plate is mounted, the mouth of the respective conical surface opens towards the conducting plate.

21. The antenna of claim 20, wherein each conical assembly comprises a central support rod having a first end adjacent said balun and a second end, a plurality of ribs connected between said balun and the second end of the central support rod, the ribs defining the substantially conical surface.

22. The antenna of claim 21, wherein the mounting assembly associated with each conical assembly is positioned at the second end of the respective central support rod.

* * * * *